US005992872A

United States Patent [19]

Proctor

[11] Patent Number: 5,992,872

[45] Date of Patent: Nov. 30, 1999

[54] SKI BOOT DESIGNED FOR USE WITH PARABOLIC ALPINE SKIS

[76] Inventor: Charles Wesley Proctor, 1912 Lafayette Ave., Greensboro, N.C. 27408

[21] Appl. No.: 08/929,345

[22] Filed: Aug. 28, 1997

[51] Int. Cl.[6] ..... A43B 5/04

[52] U.S. Cl. ..... 280/611; 280/613; 36/117.1

[58] Field of Search ..... 280/611, 613, 280/619, 623, 634; 36/117.1, 117.2, 117.3, 117.4

[56] References Cited

U.S. PATENT DOCUMENTS

| | | | |
|---|---|---|---|
| 4,880,251 | 11/1989 | Wulf | 280/613 |
| 5,005,301 | 4/1991 | Mabboux | 36/117 |
| 5,020,822 | 6/1991 | Wulf | 280/613 |
| 5,026,087 | 6/1991 | Wulf | 280/613 |
| 5,572,800 | 11/1996 | Osawa | 36/117.4 |

*Primary Examiner*—Richard M. Camby

*Attorney, Agent, or Firm*—Darby & Darby

[57] ABSTRACT

An alpine ski boot is shown which has a substantially flexible boot upper attached to a hinged sole made of two rigid parts. A rigid ankle cuff extends up from the heel of the boot to the leg opening of the boot upper. The ankle cuff has straps that may be closed around the user's ankle to secure the ankle and foot in a fixed position relative to the boot sole, and thereby to provide lateral support. The forward pitch of the ankle cuff is adjustable. The boot upper may be substantially made of flexible materials such as leather or rubber. The sole is formed of a rigid toe portion and a rigid heel portion. To facilitate walking, the two sole parts are hinged at approximately the location of the ball of the foot. The hinged sole is provided with a means to lock the two rigid parts of the sole to form the equivalent of a single rigid sole member. The locked sole can be received in a conventional automatic alpine ski binding of the type which attaches to the heel and toe of the boot. The mechanism for rigidly locking the two parts of the sole is automatically activated when the sole is pushed toe first into place in the alpine ski binding.

7 Claims, 8 Drawing Sheets

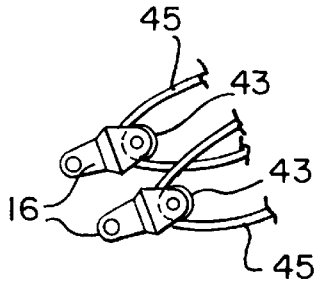
FIG. 4A
FIG. 5
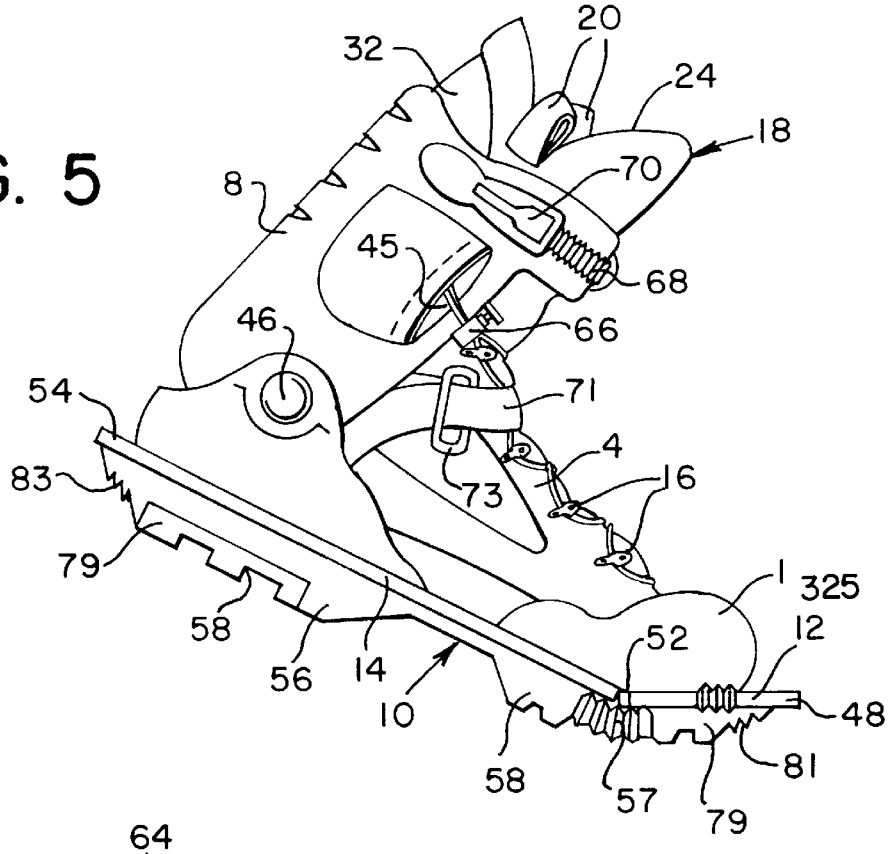
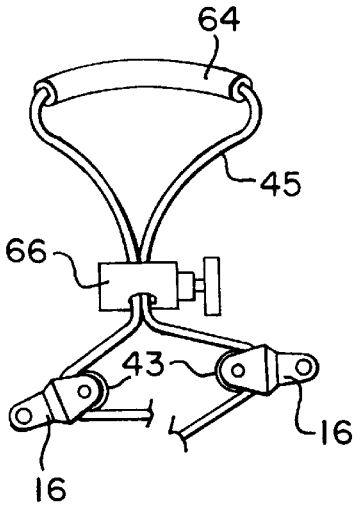
FIG. 5A

FIG. 9
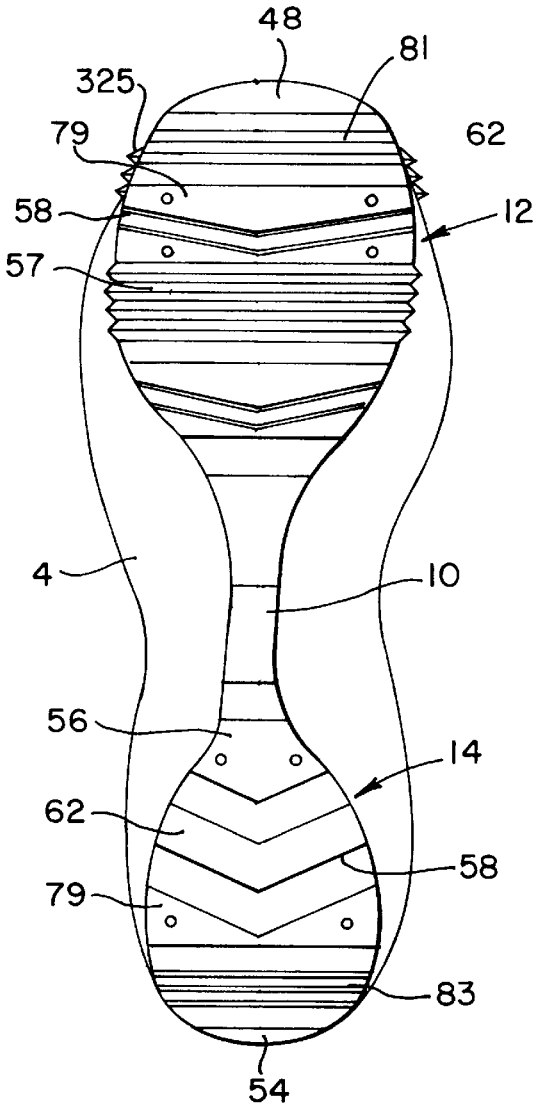
FIG. 12
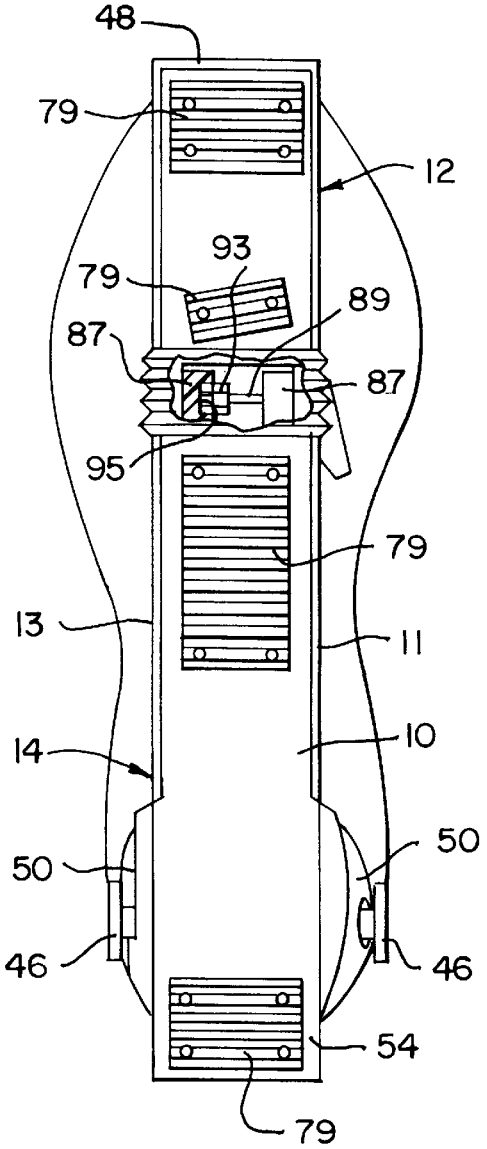
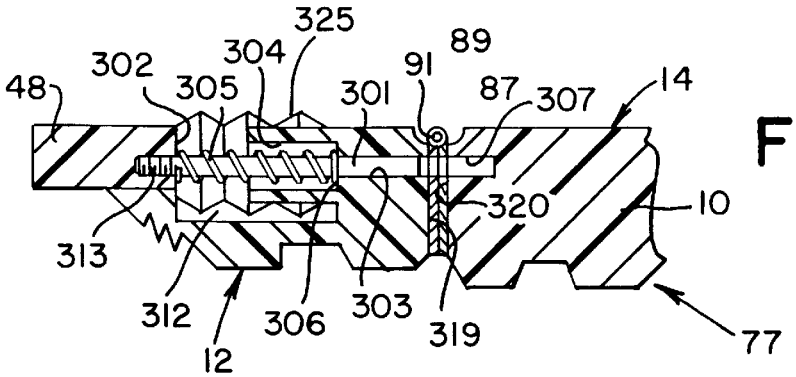
FIG. 10A

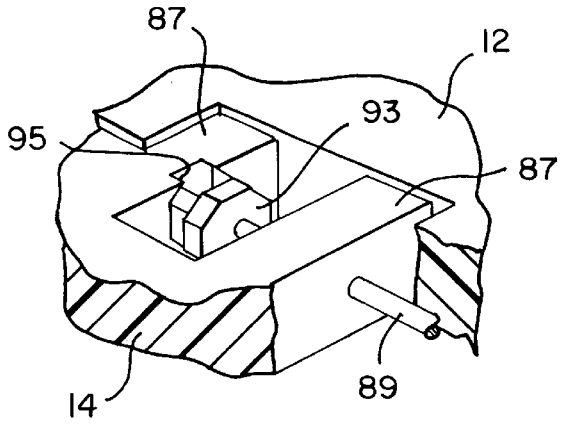
FIG. 13
FIG. 14
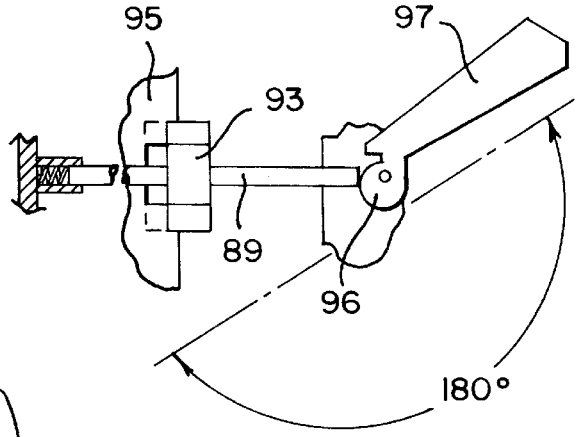
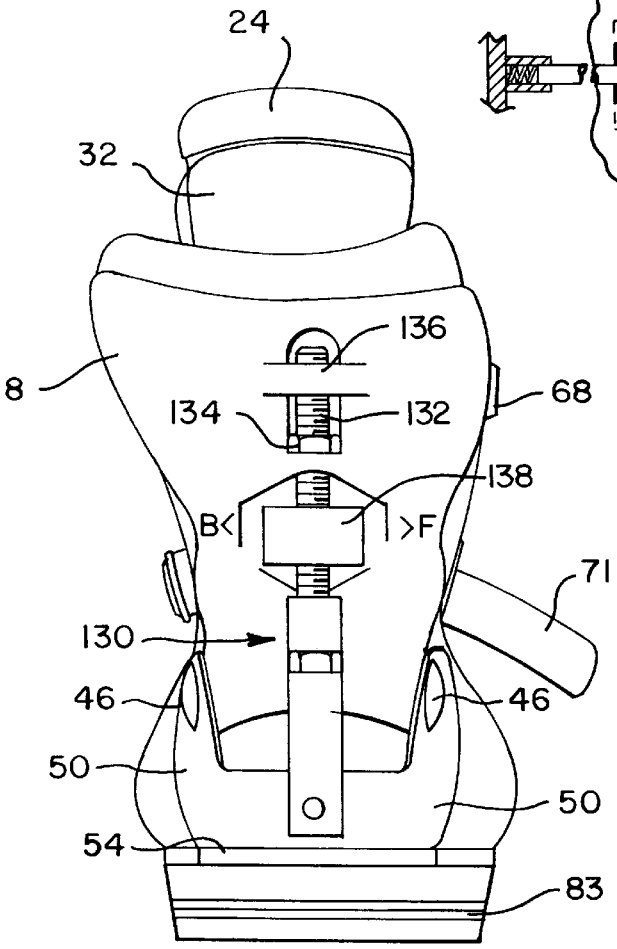
FIG. 15

SKI BOOT DESIGNED FOR USE WITH PARABOLIC ALPINE SKIS

BACKGROUND OF THE INVENTION

1. Field of the Invention

The present invention relates to alpine ski boots. In particular, it relates to ski boot structure improvements to facilitate the comfort, safety and wearability of the ski boots both on and off the skis.

2. Description of Related Art

Presently, ski boots for alpine skiing are generally of a construction having a hard plastic upper and a rigid boot sole. Despite several disadvantages boots with hard plastic uppers are the standard for alpine skiers. This standard evolved for several reasons.

Alpine ski boots require a rigid boot sole to cooperate properly with modern quick-release bindings. These spring loaded bindings allow a user to easily attach a ski by placing the toe of a booted foot into the automatic binding and stepping down on the boot heel to lock the boot to the ski. The boot is easily released from the binding by a trigger mechanism selectively activated by the user with a pole or an opposite foot. The quick-release bindings also function automatically at a predetermined setting to release the rigid boot sole in extraordinary loading situations, such as in an accident. Release of the rigid boot sole in an accident allows the skier to separate from the ski, thus preventing the ski from injuring the skier.

However, in order to properly interact with the binding for entry and release manually or automatically, the boot sole must be completely rigid from heel to toe. The binding firmly clamps the rigid boot sole to the ski, so that, under ordinary skiing conditions, the skier's foot in the ski boot is held firmly with respect to the ski attached to the binding. The firm hold of the skier's foot with respect to the ski is essential to facilitate the skier's ability to control the orientation of the skis, and thereby, to safely control the direction and speed of travel on mountain slopes.

Hard plastic uppers are said to prevent the lower leg and ankle injuries common to skiers using an earlier style of boot and binding, namely leather boots with fixed bindings.

Hard plastic uppers are also said to provide a rigid link-up between a skier's foot and leg, which allows the skier to properly shift and direct body weight to the skis to effect a turn. Conventionally shaped skis with substantially parallel sides are biased towards travel in a straight line, and resist turning. Parallel sided skis therefore require a weight shift towards the front of the ski (i.e., "forward loading") to bend the forward part of the ski sufficiently to induce the ski to carve a turn. Therefore, to better accomplish forward loading, hard plastic boots are pitched or angled forward slightly causing the skier to assume an unnatural posture with knees slightly bent.

Hard plastic boots have a number of disadvantages. Hard plastic boots are difficult to put on and take off. The hard and inflexible plastic shell requires heavy, often metal, buckles which are difficult to tighten and release. Hard plastic boots are poor insulators and are often uncomfortable in cold weather. The rigid, inflexible construction of hard plastic boots can constrict blood flow to and from the feet, causing numbness and increased susceptibility to the cold. Hard plastic boots are bulky, heavy and uncomfortable to wear both on the ski and off the ski.

Hard plastic boots are cumbersome and difficult to walk in when released from the skis. While skiing, a skier wearing hard plastic boots has enhanced control and maneuverability due to the rigid construction of the boots which firmly position the foot with respect to the ski. However, once released from the skis, hard plastic boots handicap the mobility of the wearer. Maneuvering about a ski area with the skis removed from the boots, such as, for example, maneuvering in the ski lodge, or to and from a locker or a vehicle requires extra effort and agility on the part of the wearer. The rigidity of both the sole and the uppers and the forward pitched posture of the uppers makes walking on level, dry surfaces difficult, while traversing staircases is particularly hazardous. The slippery conditions caused by ice, melting snow and mud commonly found both outside and inside ski facilities certainly compound the maneuverability problems associated with hard plastic ski boots, and may result in dangerous falls. It is not uncommon to see skiers of various ages and skill levels in hard plastic ski boots flailing their arms in a desperate attempt to regain their balance after the boots have caused a mis-step. Driving a car in hard plastic ski boots is especially difficult and dangerous, if not impossible, due to the bulk of the boots and an almost complete lack of feel for the car's accelerator and brake pedals.

U.S. Pat. Nos. 5,026,087, 5,020,822 and 4,880,251, all to Wulf et al., disclose a ski boot having a segmented foot shell rigidly attached to a sole. The segments of the foot shell overlap in sliding engagement so that a living hinge is created in the integral sole at approximately the location of the ball of the foot within the boot. To make the sole rigid for proper engagement in a ski binding, the fulcruming of the living hinge may be eliminated by locking the overlapping segments of the foot shell together. The sole therefore derives its rigidity from the foot shell, which in turn must be rigid. As noted above, a rigid sole and a rigid foot shell are thought to be necessary for proper control of conventional parallel-sided alpine skis.

The recent introduction and rapid acceptance by skiers of easy handling skis having inwardly curved opposite side edges makes it possible to create a boot without the disadvantages of the hard plastic ski boot. These skis are generally referred to in the industry as parabolic skis or, are alternatively referred to as super-sidecut skis, shaped skis or hourglass skis. The tip, or shovel, and tail of parabolic skis are significantly wider than the waist, which is the area beneath the ski boot. The dramatic shape, or sidecut, makes carving turns easier and provides greater control in nearly all snow conditions. Parabolic skis can therefore shorten the learning curve of new skiers, and increase the maneuverability and lessen the fatigue of experienced skiers. The shaped edges of parabolic skis do not resist turning to the same degree as conventional skis, and, in fact, facilitate carving turns in snow. Thus, the forces required to control the orientation and direction of parabolic skis are much lower than the forces required to control the orientation and direction of conventional skis. As a result, boots for parabolic skis need not be as rigid as conventional hard plastic ski boots. Also, because turns are more easily accomplished on parabolic skis without the degree of weight shift required on conventional skis, the rigid link-up between the skier's foot and leg is not as necessary for proper control of the skis. The rigid supporting cuff of the boot according to the present invention is made from hard plastic to provide the same type of ankle support and rigidity found in the hard plastic uppers of conventional boots.

The present invention takes advantage of the increased maneuverability of the recently developed parabolic skis to provide improvements to alpine ski boots in comfort both on and off-ski, and in off-ski maneuverability, without sacrificing on-ski performance. The primary purpose of the boot according to the invention is for use with parabolic skis, but it could alternatively be used in conjunction with other sports gear for which it may be desirable to have a rigid sole, such as, for example, conventional parallel sided skis, snowboards, in-line skates, bicycles, etc.

SUMMARY OF THE INVENTION

The boot according to the invention has a substantially flexible boot upper attached to a two part rigid sole. The sole is hinged at approximately the location of the ball of the foot within the boot. The hinged sole can be locked to be received in a conventional automatic alpine ski binding which attaches at the heel and toe of the boot. Closures on the boot upper may be of a type more commonly associated with conventional shoes and boots, such as for example, laces, zippers or hook and loop fasteners.

BRIEF DESCRIPTION OF THE DRAWINGS

FIG. 4A is a detail view of the lace pulleys for the lacing system.

FIG. 5 is a side view of the complete boot with the hinge unlocked and the sole articulated so that the heel portion of the sole is positioned at an angle relative to the toe portion of the sole.

FIG. 5A is a detail view of single pull lacing system.

FIG. 9 is a bottom plan view of the boot showing the replaceable molded tread and the hinge point at the ball of the foot with accordion gasket.

FIG. 10A is a cross-sectional elevation view of the sole showing the toe binding plate in the extended position with the hinge unlocked to permit articulation of the sole.

FIG. 12 is a bottom plan view of an alternative embodiment of the boot showing the replaceable molded tread and the hinge point at the ball of the foot with accordion gasket.

FIG. 13 is a partial perspective view of an alternative embodiment of a locking hinge.

FIG. 14 is a detail view of the alternative embodiment of a locking hinge of FIG. 13.

FIG. 15 is a back view of an alternative embodiment of the boot showing a means for adjusting the forward angle of the upper cuff.

DETAILED DESCRIPTION OF THE INVENTION

Figure 1:
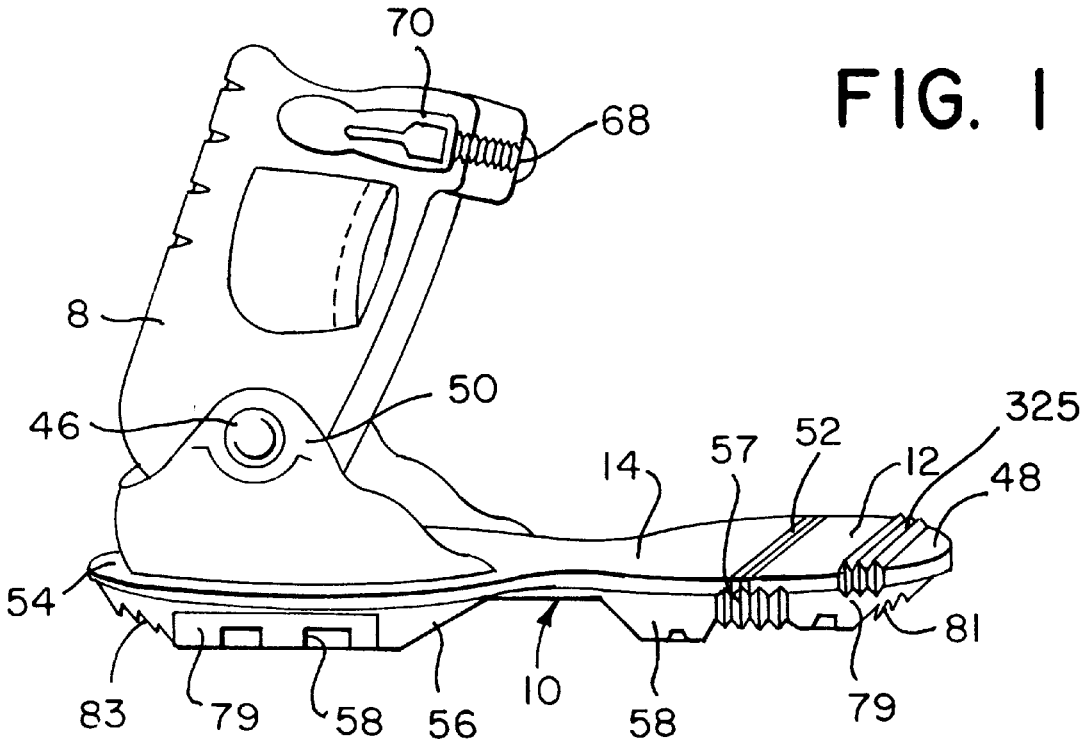
FIG. 1 is a perspective view of the supporting cuff and articulated sole of the present invention.
Figure 4:
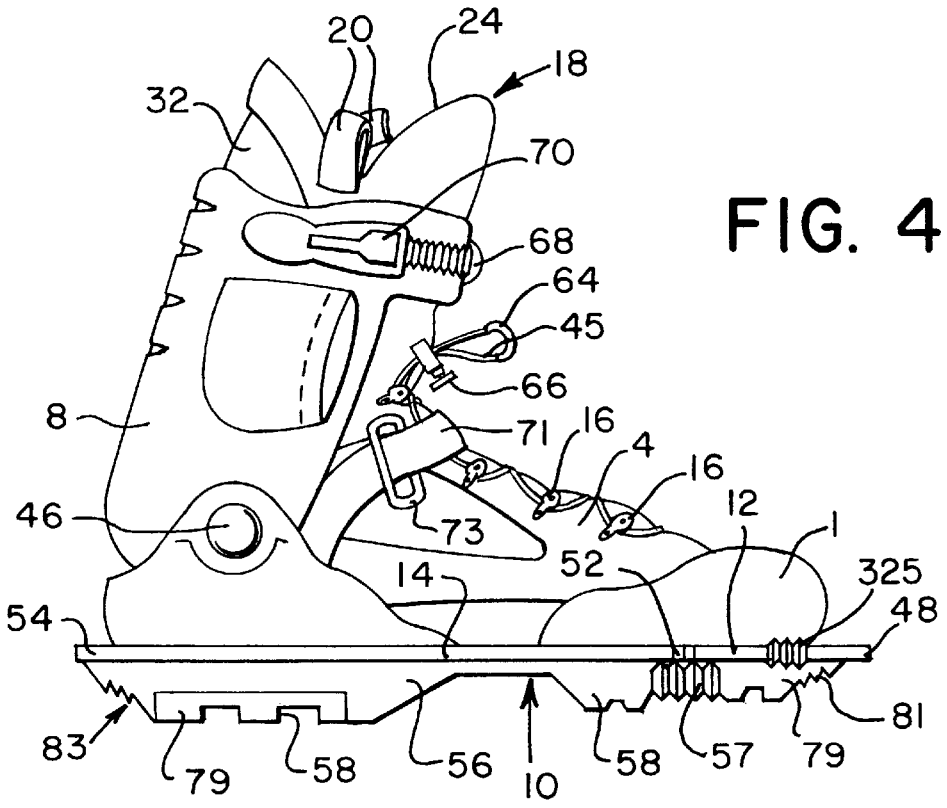
FIG. 4 is a side elevation of the complete boot of the present invention with the heel portion of the sole positioned level relative to the toe portion of the sole.
Figure 6:
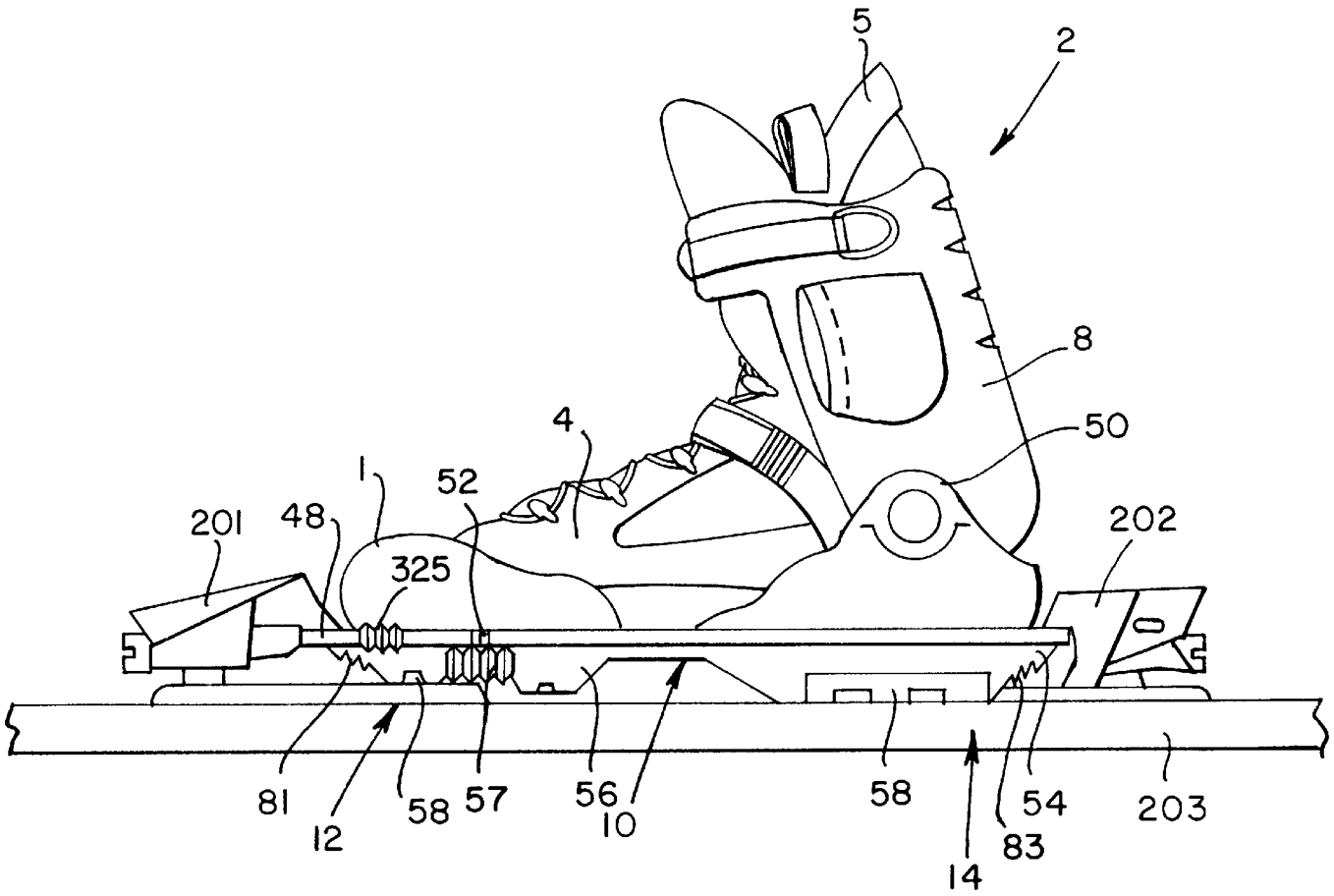
FIG. 6 is a side view of the complete boot secured in an automatic alpine ski binding mounted on a ski.
Figure 7:
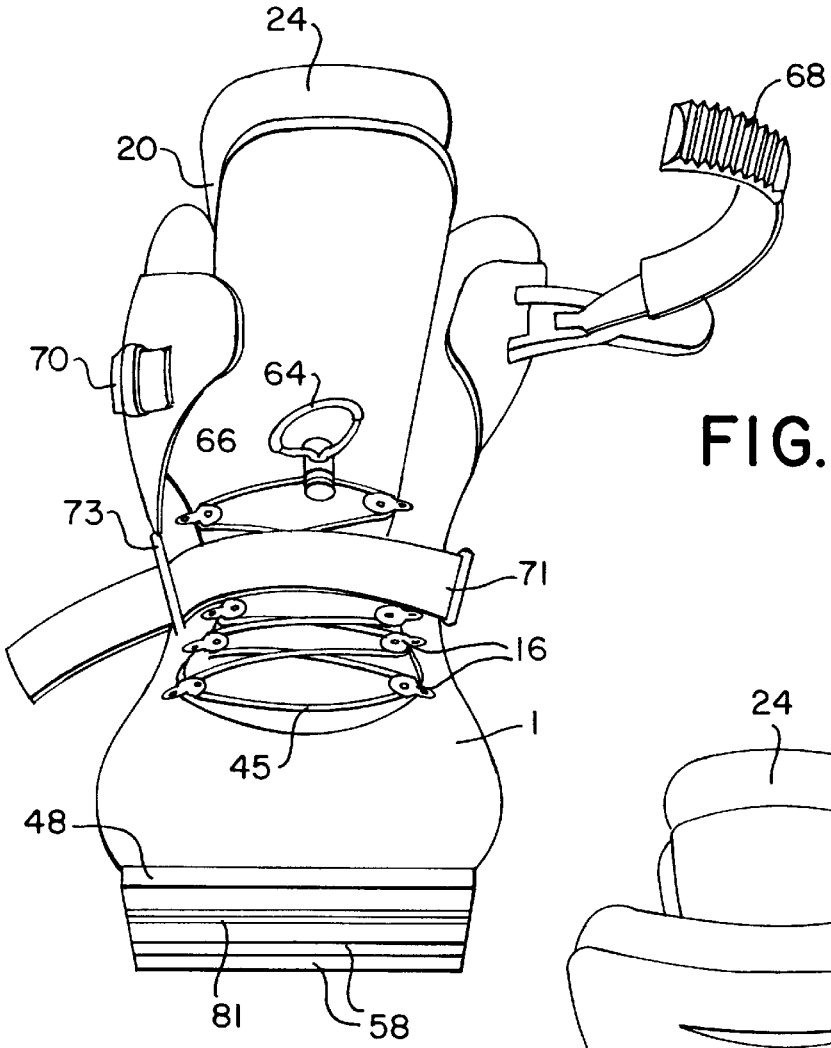
FIG. 7 is a front view of the boot showing the lacing system.
Figure 8:
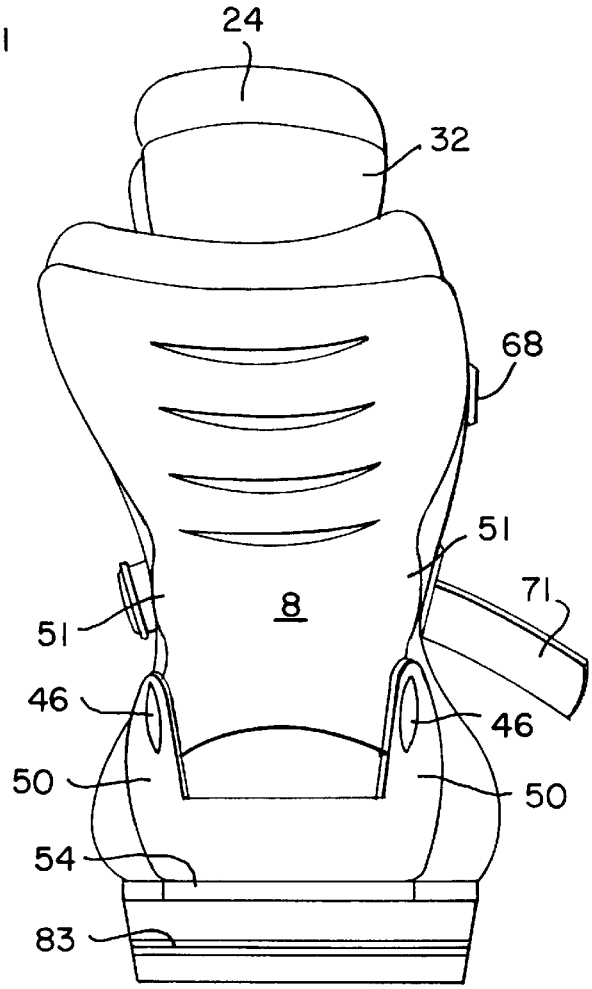
FIG. 8 is a back view of the boot showing the molded cuff support and the ankle ball extensions for additional lateral support.

An alpine ski boot according to the invention is shown generally at 2 in the drawing FIG. 4. The boot is comprised of a substantially flexible boot upper 4 (FIGS. 2 and 4) attached to a sole 10 (FIGS. 1 and 4). The sole 10 is comprised of a rigid toe portion 12 flexibly attached to a rigid heel portion 14 by a sole hinge 52 at approximately the location of the ball of the foot within the boot. The sole portions 12, 14 are adapted to be locked in a position substantially level relative to each other to form a continuous rigid sole 10 which permits the boot sole 10 to be received and secured in a conventional automatic alpine ski binding as shown in FIG. 6.

As used herein, forward or front indicates a position or orientation closer to the toe of the boot, and forwardly indicates a direction towards the toe of the boot. Conversely, rear or behind indicates a position or orientation closer to the heel of the boot, and rearwardly indicates a direction towards the heel of the boot.

A toe binding plate 48 extends from the forward end of the sole toe portion 12. A heel binding plate 54 extends from the rear end of the sole heel portion 14. As shown in FIG. 6, the toe binding plate 48 and heel binding plate 54 are adapted to be received respectively in the toe and heel bindings, 201 and 202 respectively, of an automatic ski binding to secure the boot 2 to a ski 203. A cuff hub support 50 extends upward on each side of the sole heel portion 14. A pivotally supported metal cuff hub 46 extends laterally inwardly from each cuff hub support 50.

The toe and heel portion, 12, 14 respectively, of the sole 10 can be made of any suitable rigid material, with both portions 12, 14 made of a single material, a laminate or a composite, formed as an integral unit having a living hinge. Alternatively, the each portion 12, 14 can be made of a single material, a laminate or a composite as a separate piece corresponding to the toe and heel portions, 12 and 14 respectively, the portions connected by any known hinge means. The portions 12, 14 of sole 10 are preferably each constructed as a composite with a sole supporting frame (not shown) made from a honey-combed carbon fiber reinforced material for strength and light weight. The sole supporting frame 56 has treads 58 (FIGS. 4 and 9) attached to the sole of the toe and heel portion, 12 and 14 respectively, of the sole 10. The sole supporting frame has an accordion pleated gasket 57 (FIG. 1, 4, 5 and 9) 56 to keep the sole hinge 52 clean to permit the hinge 52 to pivot freely.

Figure 10B:
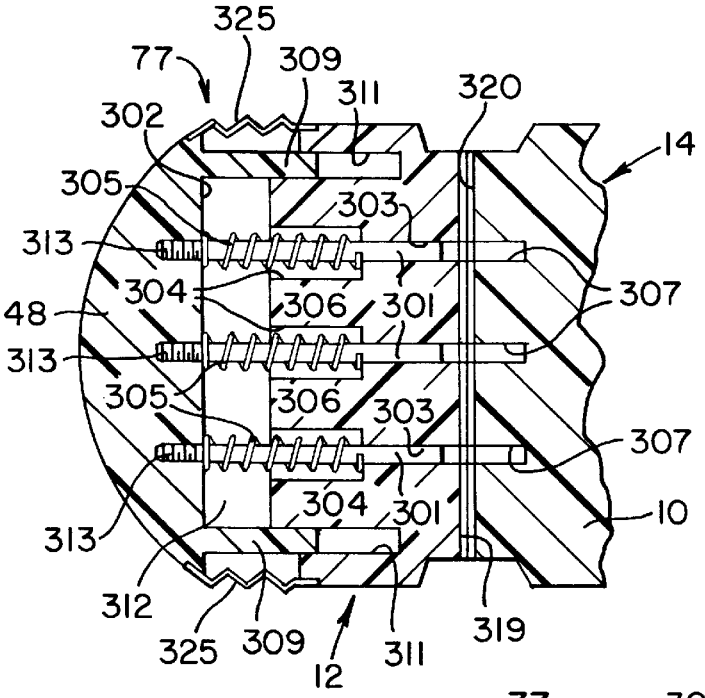
FIG. 10B is a cross-sectional plan view of the sole showing the toe binding plate in the extended position.
Figure 11A:
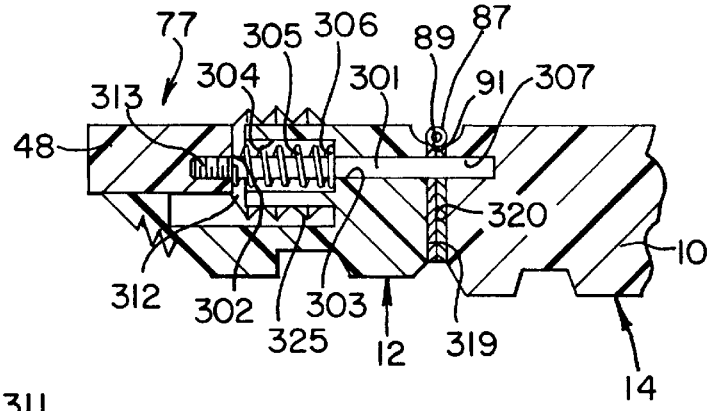
FIG. 11A is a cross-sectional elevation view of the sole showing the toe binding plate compressed to lock the hinge.
Figure 11B:
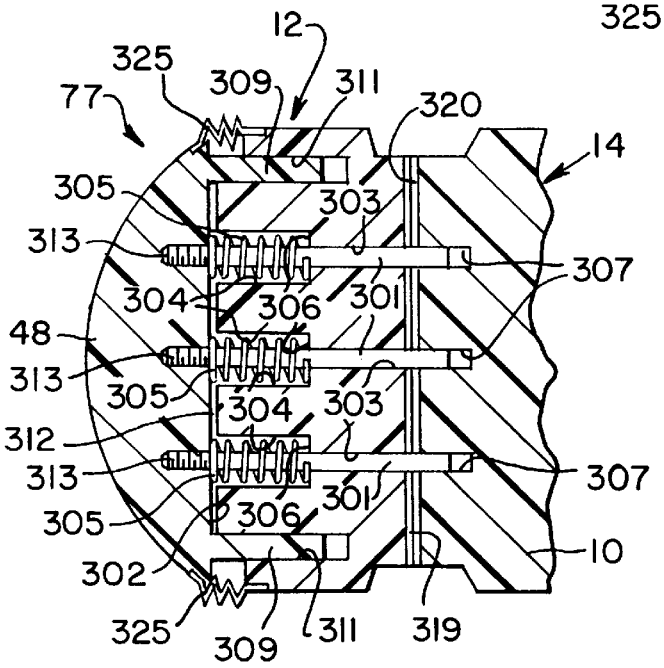
FIG. 11B is a cross-sectional plan view of the sole showing the toe binding plate compressed to lock the hinge.

As can best be seen in FIGS. 10 and 11, the hinge 52 is located in a downwardly directed clearance 60 in the sole 10 to raise the location of the hinge 52 above and away from the wearing surface 62 of the sole treads 58, thereby protecting the hinge 52 from abrasion and wear. Referring now to FIG. 9, the sole 10 is shown in a view from below the boot 2. The sole 10 is generally narrower than the boot upper 4. The sides of the sole 10, although shown as having an "hour-glass" shape in plan view, with a narrow portion adjacent the arch of the wearer's foot, may be configured in other suitable shapes, such as a shape which is substantially parallel sided.

Nylon inserts 79 may be provided as a replaceable wearing surface 62 at each of the sole toe portion 12 and the sole heel portion 14. The replaceable nylon inserts 79 are provided for durability to extend the life of the sole tread 58. The tread 58 may also be provided with a curved rocker tread 81 and 83 at the toe end and the heel end, respectively, of sole 10. The rocker treads 81, 83 provide additional comfort and traction to the user walking "out of" skis. The rocker treads 81, 83 provide the sole with a rounded, more natural, foot-like tread shape so that the user's foot rolls into and out of a step, and so that more of the tread 58 contacts the surface being traversed for additional traction.

The flexible attachment between the sole portions 12, 14 is preferably a conventional hinge such as, for example, a butt hinge, piano hinge or pin hinge. Other types of flexible attachment are contemplated, such as, for example, a flexible cord or cable, a flexible sheet material, etc. The hinge 52 can be any conventional hinge construction. For example, the flexible attachment can be a living hinge formed integrally with the materials of the sole portions 12, 14, or formed integrally with the materials of the sole supporting frame 56. The hinge 52 is preferably a butt hinge comprised of lugs 87 extending from sole toe portion 12 and lugs 87 extending from sole heel portion 14, said lugs oppositely arranged to cooperate in a closely spaced, interposed arrangement. A pin 89 passes through an aligned bore 91 in the lugs 87 (FIGS. 10, 11).

The sole portions 12, 14 can be locked relative to each other in a position along the longitudinal axis of the sole 10 by a locking means 77 (FIGS. 10, 11). The locking means 77 can be any one of several types of well known mechanisms capable of locking adjacent hinged frames in relative alignment with each other, such as, for example, a pin movable from within one of the sole portions 12, 14 to engage a corresponding bore in the opposite sole portion 12, 14. Another example is a draw hasp on one of the sole portions 12, 14 which engages a corresponding locking lug on the other sole portion 12, 14. Yet another suggested locking mechanism involves a hinge pin which is provided on at least one end with a lever operated cam. Moving the cam from a first position to a second position causes the rotational surface of the hinge pin 89 to be shortened, causing adjacent lugs 87 to frictionally engage and thereby locking the sole portions 12, 14 against further pivotal movement. In another embodiment, shown in FIGS. 12–14, the hinge pin 89 is movable in the lugs 87 laterally with respect to the longitudinal axis of the sole 10. However, the pin 89 is fixed with respect to rotational movement relative to sole heel portion 14 by being secured with respect to rotational movement to the hinge lug 87 of sole heel portion 14. Sole toe portion 12 is provided with sufficient radial movement on pin 89 to permit the toe 1 of the boot 2 to move comfortably for the user. At least one locking key 93 is secured in a fixed position on the hinge pin 89. The key 93 has an octagonal cross-section larger than the cross section of the pin 89. However, it is understood that other suitable key shapes may be provided, such as, for example, a rectangular or square cross section key which may have a larger cross section than the pin 89, or which may be smaller in cross section than the pin 89 and provided on only one side of the pin 89. A key receptacle 95 (FIG. 6), shaped and dimensioned to cooperatively receive and engage the key 93, is provided in a lug adjacent to the position of the key 93 on the pin 89. The key receptacle 95 may have a square or other shape suitable to engage the key 93. When the key 93 is moved into engagement with the key receptacle 95, radial movement of sole toe portion 12 is prevented, thereby locking sole portions 12, 14 with respect to each other, and providing a rigid sole 10 capable of being received in an alpine ski binding. When the key 93 is withdrawn from engagement of the key receptacle 95, sole toe portion 12 is free to pivot on the pin 89.

The lateral movement of pin 89, and the corresponding lateral movement of key 93, required to lock the two sole portions 12, 14, is provided to the pin 89 by a cam 96 activated by a cam lever 97 attached to the end of the pin 89 (FIG. 12). By swinging the cam lever 97 180°, the key 93 is either moved into or out of engagement with the key receptacle 95.

The preferred embodiment of the locking means 77 calls for spring loaded rods 301 which are activated by a forward or rearward movement of the toe binding plate 48 along the longitudinal axis of the sole 10. In this embodiment, the toe binding plate 48 is a separate piece, movably mounted on the toe portion 12 of the sole 10 by way of stabilizing arms 309, which are integrally molded with the body of the toe binding plate 48. The stabilizing arms 309 extend rearwardly parallel to the longitudinal axis of the sole 10, from the toe binding plate 48 to be closely received in correspondingly sized guide bores 311, also oriented parallel to the longitudinal axis of the sole 10, in the forward part of the toe portion 12. The arms 309 are slidably mounted in the guide bores 311 in such a way that the toe binding plate 48 is capable of limited forward and rearward movement along the longitudinal axis of the sole 10 with respect to the toe portion 12 of the sole 10, but cannot pivot or twist with respect to the toe portion 12 of the sole 10. As the toe binding plate 48 is moved forwardly or rearwardly, the arms 309 in conjunction with the guide bores 311 keep the toe binding plate 48 in proper alignment relative to the toe portion 12 of the sole 10.

As shown in FIGS. 10 and 11, the rods 301 are slidably mounted in rod bores 303 sized to closely receive the rods 301. A coil spring 305 is provided for each rod 301. Each coil spring 305 is positioned about its respective rod 301, with a rear end of the spring 305 in an annular enlargement 304 of the respective rod bore 303, and a front end of the spring bearing against a rear edge 302 of the toe binding plate 48. The rear end of each spring 305 bears against a shoulder 306 formed at the rear end of the annular enlargement 304 of each respective bore 303. The coil springs are biased to drive the toe binding plate a selected distance in a direction away from the toe portion 12 of the sole 10, i.e. forwardly relative to the sole 10. By driving the toe binding plate in a forward direction, a gap 312, shown in FIG. 10, forms between the toe binding plate 48 and the toe portion 12 of the sole 10. The rods 301, which are preferably metal, are fixedly attached at a forward end 313 to the toe binding plate 48, which as noted above may be rigid plastic or metal, by any known fastening means, such as bonding, threading, compression fitting, welding, etc. Thus when the toe binding plate 48 is driven by the springs 305 in a direction away from the toe portion 12 of sole 10, i.e., forwardly relative to the sole 10, the rods 301 slide forwardly in bores 303 within the toe portion 12 which is held in a fixed position relative to the sole 10 by hinge 52. At the full permitted forward extension of the springs 305, i.e. at the full extent of the selected distance of movement of the toe binding plate 48 in the forward direction, the rear ends 317 of the rods 301 are substantially positioned within the bores 303 in the toe portion 12 of the sole 10.

As shown in FIG. 11, an external force applied in the direction of the arrows 315 overcomes the bias of the springs 305 thereby driving the toe binding plate 48 in a rearward direction towards the toe portion 12 of the sole 10. The springs 305 are compressed by this external force, and the gap 312 is substantially closed. The rods 301, which are attached to the toe binding plate 48, therefore slide rearwardly in the bores 303 in the toe portion 12 of sole 10. The length of the portion of the rods 301 which extends rearwardly from the toe binding plate 48 is greater than the length from front to rear of the toe portion 12 of the sole 10. Thus, the rear ends 317 of rods 301 extend rearwardly beyond a rear edge 319 of toe portion 12 of sole 10. The rear ends 317 of the rods 301 extend rearwardly from the rear edge 319 of the toe portion 12 past the hinge 52 into corresponding forwardly directed rod pockets 307 in the forward edge 320 of the heel portion 14 of the sole 10. The rod pockets 307 are dimensioned to closely fit the rear ends 317 of the rods 301. In order for the rods 301 to slide into and engage the rod pockets 317, the rod pockets 317 must be in alignment with the rods 301. The rod pockets 317 are therefore oriented in the heel portion 14 such that the toe portion 12 and the heel portion 14 must be in substantially level alignment to permit the rear ends 317 to fully engage the rod pockets 307, i.e. the toe portion 12 must not be angled with respect to the heel portion 14. As the rear ends 317 of the rods 301 fully engage the rod pockets 307, the rods 301 lock the toe portion 12 relative to the heel portion 14 of the sole 10.

In other words, in a first rearward position shown in FIG. 11, the rods 301 engage corresponding rod receiving pockets 307 to lock the toe portion 12 in a level, non-pivoting position relative to the heel portion 14 of the sole 10, thus forming a continuous rigid sole 10 capable of being received in and secured to a conventional automatic alpine ski binding 201, 202 as shown in FIG. 6. In a second forward position shown in FIG. 10, the rods 301 are disengaged from the rod pockets 307, allowing the toe portion 12 to pivot on hinge 52 independently from heel portion 14 of sole 10, thus providing a flexible sole 10 for walking comfort when the boot 2 is not mounted in a ski binding 201, 202.

A pleated gasket 325 seals the gap 312 between the rear of the toe binding plate 48 and the toe portion 12 of the sole 10, to keep out foreign materials.

In use, the springs 305 bias the toe binding plate 48 and attached rods 301 away from the heel portion 14 of the sole, so that the ends 317 of the rods 301 do not engage the rod pockets 307. Thus, the toe portion 12 of the sole 10 is permitted to pivot on hinge 52 relative to the heel portion 14 of the sole 10. The sole 10 is thus flexible for the wearer's comfort in normal walking without skis on. To use the boots in skis, the wearer places the toe binding plate 48 into the toe binding 201(FIG. 6) of an automatic binding. The wearer pushes the boot forward into the toe binding 201, thus providing the external force shown by arrows 315 in FIG. 11. The external force pushes the toe binding plate 48 rearwardly which simultaneously compresses the springs 305 and moves the rods 301, and in particular, the rear ends 317 of the rods 301 into engagement with the rod pockets 307. The toe portion 12 of the sole 10 is thus locked against pivotal movement with respect to heel portion 14 of the sole 10, providing a rigid sole 10. The user then pushes the heel plate 54 downwardly to lock the rigid sole 10 into the heel binding 202, which in turn locks the toe binding plate 48 into the toe binding 201 of the automatic ski binding. For safety, the parts of the sole 10, including the toe binding plate 48, the toe portion 12, the heel portion 14, the hinge 52 and heel binding plate 54, are dimensioned so that the sole 10 will not fit into an automatic ski binding until the sole portions 12 and 14 are locked against pivoting by the locking means 77.

Figure 2:
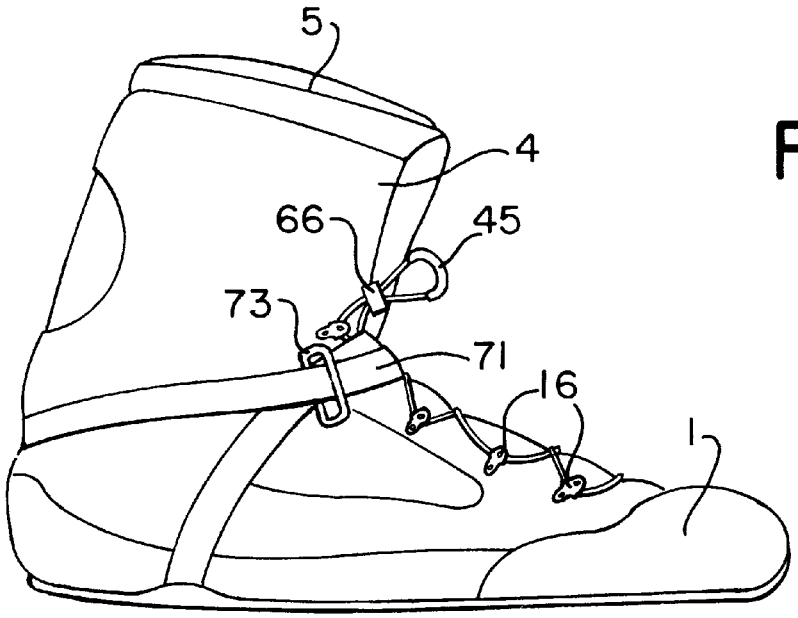
FIG. 2 is a perspective view of the soft boot upper.
Figure 3:
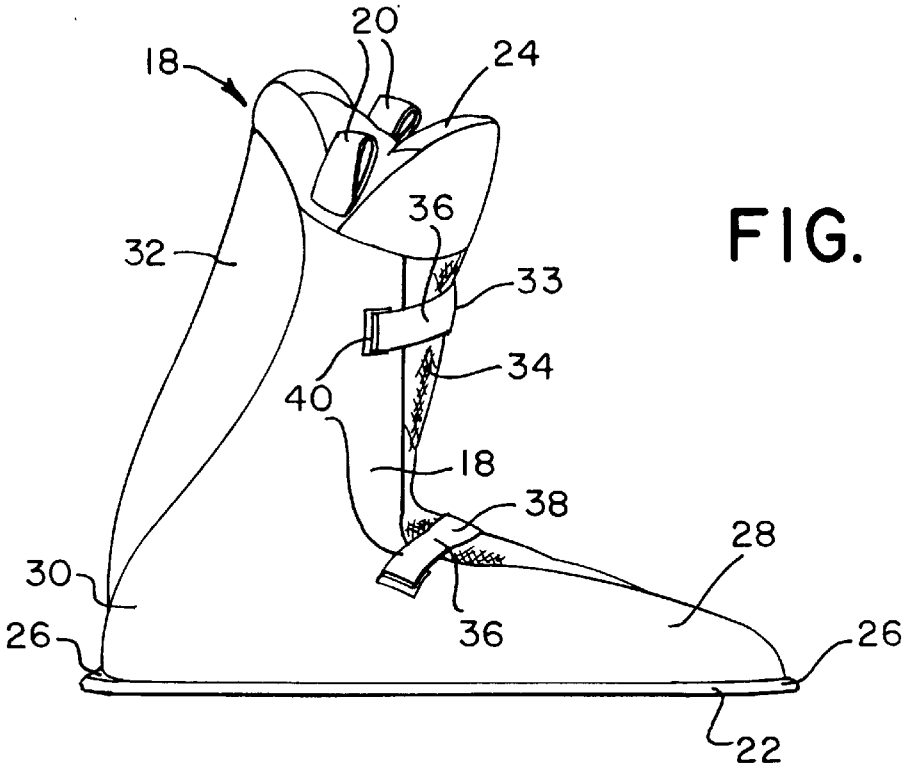
FIG. 3 is a perspective view of the optional inner boot.

The boot upper 4 shown in FIGS. 2 and 4 has an upwardly directed leg opening 5. The "soft" portion of the boot upper 4 shown in FIG. 2 may be made from one or more materials, such as, for example, those conventionally used in the construction of footwear for outdoor recreation, e.g., leather, rubber, natural or synthetic elastomer, canvas, nylon fabrics, Gore-Tex, plastic, etc. Preferably, the material or materials selected for a substantial portion of the upper is flexible and sufficiently elastic to provide a tight yet comfortable fit without constricting blood circulation in the wearer's foot. Preferably, the material or materials selected for substantial portions of the upper are water resistant or waterproof to shed snow and moisture from sources external to the boot. The inclusion of material or materials that are breathable, i.e. that transmit vapor, is also contemplated, to provide ventilation to exhaust body moisture and thereby, to keep the wearer's foot dry and comfortable. In the preferred embodiment, the toe 1 is made from rubber, and the balance of the "soft" portion of the upper is made from leather and fabric.

Portions of the boot upper may be made from or reinforced with rigid materials, such as, for example, metal or rigid plastic or nylon. For example, an upper cuff 8 may be provided as a rigid plastic portion of the boot upper. These reinforcements of the flexible upper may provide additional support for various purposes, such as, for example, to protect from injury sensitive parts of the wearer's foot, such as the toes and ankles. Alternatively, the reinforcements could, for example, transmit leverage or loading forces from the wearer's foot to the ski attached to the boot 2, thus facilitating control of the ski.

In the preferred embodiment, the rigid upper cuff 8 is provided in such a way that it surrounds the heel and ankle of the wearer's foot, when the foot is positioned in the boot, at the rear of the sole adjacent a rear portion of the boot upper 4. The upper cuff 8 is preferably made of a rigid plastic. The upper cuff 8 is pivotally secured to laterally inwardly extending cuff hubs 46, located on upwardly extending hub supports 50 on opposite sides of the heel portion 14 of the sole 10. The upper cuff 8 extends upwardly from the sole 10 substantially to the top of the boot 2, and extends from the back of the boot upper 4 forward on each side of the boot upper 4 to a point approximately vertically aligned with the leading edge of the heel tread 58 of the heel portion 14 of the sole. Ankle ball extensions 51 project laterally from the upper cuff 8 for additional support. Preferably, the upper cuff 8 is secured about the user's ankle by a ratchet strap system having a strap 68 and ratchet buckle 70. A cinching strap system comprised of a nylon strap 71 having hook and loop fasteners (i.e., Velcro) and a securing loop 73 secures a user's heel and ankle firmly within the boot. The upper cuff 8 has a pocket for storing excess laces when the laces are tightened. The upper cuff 8, once secured to the user provides excellent lateral support and stability and facilitates control of the orientation of a ski attached to the boot.

The "soft" portion of the boot upper is secured to the sole portions 12, 14 and the upper cuff 8 by rivets and glue or other suitable fastening means.

Means may be provided for adjusting the forward angle of the upper cuff 8 with respect to the sole 10. For example, adjustment means 130 (FIG. 15) may be provided on the back of the upper cuff 8. The adjustment means 130 (FIG. 15) is comprised of a screw 132 movable with respect to at least one fixed nut 134 and an anchored rotating cap 136. A knurled knob 138 rotates the screw 132 to move the screw 132 up or down, depending on the direction of rotation of the knob 138. This raises or lowers the back end of the upper cuff 8, the front end of the upper cuff pivoting on hubs 46 at a fixed distance from the sole 10, thus causing the upper cuff 8 to pitch forward or backward relative to the sole 10.

The boot upper 4 may be closed and secured to the users foot by any conventional means, such as, for example, laces, straps and buckles, straps and hook and loop fasteners, buckles, etc. or a combination thereof. Preferably, the boot upper is closed by laces 45 on lace supports 16 (FIGS. 4. 4A and 5). The lace supports 16 may have pulleys to facilitate tightening of the laces 45. The ends 64 of the laces 45 are connected so that the laces 45 coming from each side of the boot can be pulled simultaneously and secured in a sliding cinch mechanism 66 such as a spring clincher.

Additional insulation and water protection abilities are provided to the boot 2 by a removable inner boot 18 having a toe portion 28, a heel portion 30 and a leg portion 32 with a leg opening 24. The inner boot 18 is shaped to closely fit the wearer's foot and is substantially made from a waterproof and breathable fabric, such as, for example, Gore-Tex™. The inner boot 18 is padded. The inner boot 18 has a pair of opposite pull-up straps 20 attached to the leg portion 32 of the inner boot 18 adjacent to the leg opening 24. The straps 20 are adapted to assist the user in donning the inner boot 18. A stretch panel 34 located in the leg portion 32 of the inner boot 18 permits the leg opening 24 to expand to allow the user's foot to enter the inner boot. A fitting strap 36 having a fixed end 38 and a free end 40 is provided to close the leg opening 24 and secure the leg portion 32 about the user's leg. A hook and loop fastener secures the free end of the fitting strap 36 to the leg portion 32 of the inner boot 18. Although the inner boot 18 is secured to the user by the strap 36 and hook and loop fastener in the preferred embodiment, the inner boot 18 may be secured to the user by any conventional means, such as, for example, laces, straps and buckles, snaps, etc.

The inner boot 18 also has an insulated sole 22. A fitting flange 26 extends laterally away from a portion of the sole 22 adjacent to the toe portion 28 or the heel portion 30, or both, of the inner boot 18. The fitting flange 26 can be cut to size to fit snugly in the foot cavity of the boot upper 4. In the preferred embodiment, the sole 22 is made of rubber having sufficient strength and durability to permit the inner boot 18 to be worn on indoor floors and surfaces, or on dry surfaces outdoors.

In an alternative construction in which use of an inner boot is not contemplated, the "soft" portion of the boot upper 4 shown in FIG. 2 is provided with extra padding in the tongue, ankle and heel portions of the boot.

Various changes may be made to the invention without departing from the spirit thereof or the scope of the following claims.

What is claimed is:

1. An alpine ski boot having a sole with a toe end and a heel end for releasable attachment to a ski and a substantially flexible boot upper attached to said sole, said sole comprising:

a first rigid sole portion generally corresponding to said toe end of said sole, and a second rigid sole portion generally corresponding to said heel end of said sole, said first and second rigid sole portions connected by a transversely oriented flexible connector, said flexible connector located proximal to a ball of a foot when said foot is within the boot; and means for locking together said first and second rigid sole portions in alignment along a longitudinal axis extending between said toe and said heel end wherein said flexible connector is a hinge, said hinge comprises a first hinge lug extending toward said heel end of said sole from said first rigid sole portion, a second hinge lug extending toward said toe end of said sole from said second rigid sole portion, said first and second hinge lugs laterally offset to be adjacent to each other, said first and second hinge lugs each having a lateral pin bore, said lateral pin bores cooperatively aligned, and said first and second hinge lugs connected by a hinge pin inserted through said cooperatively aligned pin bores.

2. The alpine ski boot of claim 1, wherein a key is attached to said hinge pin, said first hinge lug has a key receptacle dimensioned to receive and engage said key, and said hinge pin with said attached key is adapted to move laterally in said cooperatively aligned pin bores to selectively position the key in the key receptacle so that rotation of the first hinge lug with respect to the second hinge lug is prevented.

3. The alpine ski boot of claim 2, wherein said lateral movement of said hinge pin is provided by a lever cam.

4. An alpine ski boot having a sole with a toe end and a heel end for releasable attachment to a ski and a substantially flexible boot upper attached to said sole, said sole comprising:

a first rigid sole portion generally corresponding to said toe end of said sole, and a second rigid sole portion generally corresponding to said heel end of said sole, said first and second rigid sole portions connected by a transversely oriented flexible connector, said flexible connector located proximal to a ball of a foot when said foot is within the boot;

means for locking together said first and second rigid sole portions in alignment along a longitudinal axis extending between said toe and said heel end, wherein a toe binding plate extends from said toe end of said sole, and a heel binding plate extends from said heel end of said sole, said toe binding plate and heel binding plate adapted to be received respectively in a toe binding and a heel binding of an alpine ski binding;

wherein said boot upper includes a rigid ankle cuff attached to and extending upwardly from said heel end of said sole to an upper end, said ankle cuff having a back wall and opposite side walls extending forward from said back wall, said ankle cuff positioned to substantially surround a back and sides of an ankle and a heel of a foot when the foot is in said boot, said ankle cuff having at least one strap attached to said ankle cuff upper end, said strap capable of being releasably closed about the ankle; and adjustment means for adjusting a forward angle of said ankle cuff with respect to said sole.

5. The alpine ski boot of claim 4, wherein said adjustment means has a first end attached to said ankle cuff and a second end attached to said sole, and wherein at least one wall of said ankle cuff is pivotally attached to said sole.

6. The alpine ski boot of claim 5 wherein each of said sidewalls of said ankle cuff are pivotally mounted on an opposite side of said sole proximal to said heel, and wherein said adjustment means is mounted to said back of said boot upper, said adjustment means comprising a knob secured to a screw, the knob and screw rotatable with respect to a bearing cap attached to said cuff at said first end and rotatable with respect to a fixed nut attached to said sole at said second end, said forward angle of said ankle cuff being controlled by rotation of said knob.

7. An alpine ski boot for releasable attachment to a ski, the boot comprising:

a rigid sole having an upper surface, a lower surface opposite said upper surface, and a peripheral edge connecting said upper and lower surface, said sole having a toe end and a heel end, said toe end having a toe binding plate and said heel end having a heel binding plate, said heel and toe binding plates adapted to be received in an alpine ski binding:

a substantially flexible boot upper, said boot upper having a rigid ankle cuff attached to and extending upwardly from said heel end of said sole to an upper end, said ankle cuff having a back wall and opposite side walls extending forward from said back wall, each of said sidewalls of said ankle collar pivotally mounted on an opposite side of said sole proximal to said heel, said ankle cuff positioned to substantially surround a back and sides of an ankle and a heel of a foot, said ankle collar having at least one forwardly directed strap attached to said ankle cuff upper end, said extension capable of being releasably closed about said ankle; and means for adjustment mounted to said back of said boot upper with a first end attached to said ankle collar and a second end attached to said sole, said means for adjustment comprising a knob secured to a screw, the knob and screw rotatable with respect to a bearing cap attached to said collar at said first end and a rotatable with respect to a fixed nut attached to said sole at said second end, wherein a forward angle of said ankle collar with respect to said sole is adjustable by rotation of said knob.

* * * * *